United States Patent [19]

Garwood et al.

[11] Patent Number: 5,037,528

[45] Date of Patent: Aug. 6, 1991

[54] LUBRICANT PRODUCTION PROCESS WITH PRODUCT VISCOSITY CONTROL

[75] Inventors: William E. Garwood, Haddonfield; Quang N. Le, Cherry Hill; Stephen S. Wong, Medford, all of N.J.

[73] Assignee: Mobil Oil Corporation, Fairfax, Va.

[21] Appl. No.: 517,958

[22] Filed: Apr. 30, 1990

Related U.S. Application Data

[63] Continuation of Ser. No. 312,096, Feb. 16, 1989, abandoned, which is a continuation-in-part of Ser. No. 81,790, Aug. 5, 1987, abandoned, which is a continuation-in-part of Ser. No. 793,937, Nov. 1, 1985, abandoned, Ser. No. 44,187, Apr. 30, 1987, abandoned, and Ser. No. 12,909, Feb. 9, 1987, abandoned.

[51] Int. Cl.[5] ..... C10G 73/38; C10G 73/42

[52] U.S. Cl. ..... 208/27; 208/18; 208/58; 208/59; 208/95; 208/97; 208/291; 585/739

[58] Field of Search ..... 208/58, 59, 97, 95, 208/18, 240, 27, 24, 46, 96, 291; 585/739

[56] References Cited

U.S. PATENT DOCUMENTS

| | | | |
|---|---|---|---|
| 3,128,246 | 4/1964 | Oberright et al. | 208/255 |
| 3,594,320 | 7/1971 | Orkin | 252/59 |
| 3,684,691 | 8/1972 | Arey et al. | 208/59 |
| 4,140,619 | 2/1979 | van der Wiel et al. | 208/27 |
| 4,547,283 | 10/1985 | Neel et al. | 208/46 |
| 4,554,065 | 11/1985 | Albinson et al. | 208/59 |
| 4,594,172 | 6/1986 | Sie | 252/55 |
| 4,601,993 | 7/1986 | Chu et al. | 502/66 |
| 4,612,108 | 9/1986 | Angevine et al. | 208/111 |
| 4,618,737 | 10/1986 | Chester et al. | 585/329 |
| 4,678,556 | 7/1987 | Hicks et al. | 208/96 |

FOREIGN PATENT DOCUMENTS

| | | | |
|---|---|---|---|
| 1454498 | 11/1976 | United Kingdom | 208/46 |
| 1456858 | 12/1976 | United Kingdom | 208/18 |

*Primary Examiner*—Anthony McFarlane

*Attorney, Agent, or Firm*—Alexander J. McKillop; Charles J. Speciale; Richard D. Stone

[57] ABSTRACT

High viscosity index, low pour point lubricants are produced by the oligomerization of a wax-derived lubricant fraction. The fraction may be produced from slack wax or de-oiled wax by hydroisomerization over zeolite beta or hydrocracking/isomerization over an amorphous catalyst followed by selective dewaxing, preferably by catalytic dewaxing over a highly shape selective zeolite such as ZSM-23. The preferred peroxides are ditertiary alkyl peroxides such as ditertiary butyl peroxide (DTBP) and are typically used at temperatures of 100°-300° C.

19 Claims, 1 Drawing Sheet

LUBRICANT PRODUCTION PROCESS WITH PRODUCT VISCOSITY CONTROLCROSS-REFERENCE TO RELATED APPLICATION

This application is a continuation of 07/312,096filed 02/16/89, now abandoned, which is a CIP of 07/081,790, filed 08/05/87, and now abandoned. Ser. No. 081,790 is a Continuation in part of three prior applications, 06/793,937 filed 11/01/85, now abandoned, 07/044,187 filed 04/30/87now abandoned, and 07/012,909 filed 01/09/87 and now abandoned.

FIELD OF THE INVENTION

The present invention relates to the production of lubricants of mineral oil origin which are characterized by high viscosity indices, low pour points and other desirable properties and which may be produced in good yields from readily available refinery streams.

CROSS-REFERENCE TO RELATED APPLICATIONS

This application is a continuation-in-part of copending application Serial No. 081,790, filed Aug. 5, 1987, which is a continuation-in-part of application Ser. No. 793,937, filed Nov. 1, 985, application Ser. No. 044,187, filed 30 Apr. 1987, and application Ser. No. 012,909 filed Feb. 9, 1987.

The present lubricants may be made by a process including the sequence of process steps described in Ser. No. 793,937 and accordingly, the entire contents of the specification of Ser. No. 793,937 are incorporated in this application by this reference to it. The wax hydroisomerisation and dewaxing steps which may be used in the present process are described in Ser. No. 044,187 and accordingly the entire contents of Ser. No. 044,187 are incorporated in this application by this reference to it. The wax hydrocracking and dewaxing steps of Ser. No. 012,909 may be used in the present process and accordingly the entire contents of Ser. No. 012,909 are incorporated in this application by this reference to it.

BACKGROUND OF THE INVENTION

Mineral oil lubricants are derived from various crude oil stocks by a variety of refining processes directed towards obtaining a lubricant base stock of suitable boiling point, viscosity, viscosity index (VI) and other characteristics. Generally, the base stock will be produced from the crude oil by distillation of the crude in atmospheric and vacuum distillation towers, followed by the separation of undesirable aromatic components and finally, by dewaxing and various finishing steps. Because aromatic components lead to high viscosity and extremely poor viscosity indices, the use of asphaltic type crudes is not preferred as the yield of acceptable lube stocks will be extremely low after the large quantities of aromatic components contained in such crudes have been separated out; paraffinic and naphthenic crude stocks will therefore be preferred but aromatic separation procedures will still be necessary in order to remove undesirable aromatic components. In the case of the lubricant distillate fractions, generally referred to as the neutrals, e.g. heavy neutral, light neutral, etc., the aromatics will be extracted by solvent extraction using a solvent such as phenol, furfural, N-methylpyrolidone or another material which is selective for the extraction of the aromatic components. If the lube stock is a residual lube stock, the asphaltenes will first be removed in a propane deasphalting (PDA) step followed by solvent extraction of residual aromatics to produce a lube generally referred to as bright stock.

The solvent extration to remove undesirable aromatic components is normally followed by a dewaxing step which is normally necessary in order for the lubricant to have a satisfactorily low pour point and a cloud point, so that it will not solidify or precipitate the less soluble paraffinic components under the influence of low temperatures. A number of dewaxing processes are known in the petroleum refining industry and of these, solvent dewaxing with solvents such as methylethylketone (MEK) and liquid propane, has been the one which has achieved the widest use in the industry. Recently, however, proposals have been made for using catalytic dewaxing processes for the production of lubricating oil stocks and these processes possess a number of advantages over the conventional solvent dewaxing procedures. The catalytic dewaxing processes which have been proposed are generally similar to those which have been proposed for dewaxing the middle distillate fractions such as heating oils, jet fuels and kerosenes, of which a number have been disclosed in the literature, for example, in Oil and Gas Journal, Jan. 6, 1975, pp. 69–73 and U.S. Pat. Nos. RE 28,398, 3,956,102 and 4,100,056. At least one of these processes, the Mobil lube Oil Dewaxing Process (MLDW) has now reached maturity and is capable of producing low pour point oils not attainable by solvent dewaxing. See 1986 Refining Process Handbook, Gulf Publishing Co., (Sept. 1986 Hydrocarbon Processing), page 90.

Generally, these catalytic dewaxing processes operate by selectively cracking the longer chain end paraffins to produce lower molecular weight products which may then be removed by distillation from the higher boiling lube stock. The catalysts which have been proposed for this purpose have usually been zeolites which have a pore size which admits the straight chain, waxy n-paraffins either alone or with only slightly branched chain paraffins but which exclude more highly branched materials and cycloaliphatics. Zeolites such as ZSM-5, ZSM-11, ZSM-12, ZSM-22, ZSM-23, and the synthetic ferrierites ZSM-35 and ZSM-38 have been proposed for this purpose in dewaxing processes, as described in U.S. Pat. Nos. 3,894,938, 4,176,050, 4,181,598, 4,222,855, 4,229,282 and 4,247,388. A dewaxing process employing synthetic offretite is described in U.S. Pat. No. 4,259,174. The relationship between zeolite structure and dewaxing properties is discussed in J. Catalysis 86, 24–31 (1984).

Although the catalytic dewaxing processes are commercially attractive because they do not produce quantities of solid paraffin wax which presently is regarded as an undesirable, low value product, they do have certain disadvantages and because of this, certain proposals have been made for combining the catalytic dewaxing processes with other processes in order to produce lube stocks of satisfactory properties. For example, U.S. Pat. No. 4,181,598 discloses a method for producing a high quality lube base stock by subjecting a waxy fraction to solvent refining, followed by catalytic dewaxing over ZSM-5 with subsequent hydrotreatment of the product. U.S. Pat. No. 4,428,819 discloses a process for improving the quality of catalytically dewaxed lube stocks by subjecting the catalytically dewaxed oil to a hydroisomerization process which removes residual quantities of petrolatum wax which contribute to poor performance in the Overnight Cloud Point test (ASTM D2500-66).

As mentioned above, the conventional catalytic dewaxing processes using intermediate pore size zeolites such as ZSM-5 operate by selectively cracking the waxy components of the feed. This results in a loss in yield since the components which are in the desired boiling range undergo a bulk conversion to lower boiling fractions which, although they may be useful in other products, must be removed from the lube stock. A notable advance in dewaxing process is described in U.S. Pat. Nos. 4,419,220 and 4,518,485, in which the waxy components of the feed, comprising straight chain and slightly branched chain paraffins, are removed by isomerization over a catalyst based on zeolite beta. During the isomerization, the waxy components are converted to relatively less waxy isoparaffins and at the same time, the slightly branched chain paraffins undergo isomerization to more highly branched aliphatics. A measure of cracking does take place during the operation so that not only is the pour point reduced by reason of the isomerization but, in addition, the heavy ends undergo some cracking or hydrocracking to form liquid range materials which contribute to a low viscosity product. The degree of cracking is, however, limited so as to maintain as much of the feedstock as possible in the desired boiling range. As mentioned above, this process uses a catalyst which is based on zeolite beta, together with a suitable hydrogenation-dehydrogenation component which is typically a base metal or a noble metal, usually of group VIA or VIIIA of the Periodic Table of the Elements (the periodic table used in this specification is the table approved by IUPAC), such as cobalt, molybdenum, nickel, tungsten, palladium or platinum. As described in U.S. Pat. No. 4,518,485, the isomerization dewaxing step may be proceded by a hydrotreating step in order to remove heteroatom-containing impurities, which may be separated in an interstage separation process similar to that employed in two-stage hydrotreating-hydrocracking processes.

With the present trend to more severe service ratings, there is a need to develop better lubricants. For example, the SAE service ratings of SD and SE are becoming obsolescent as more engine manufacturers specify an SF rating and it is expected that even more severe ratings will need to be met in the future as engine core temperatures increase in the movement toward greater engine efficiency. This progressive increase in service severity is manifested by improved resistance to oxidation at high temperatures and by higher V.I. requirements to ensure that the lubricants will have adequate viscosity at high temperatures without excessive viscosity when the engine is cold. In part, the improved performance may be obtained by improved additive technology but significant advances will be needed in basestock performance to accommodate more severe service requirements.

Because of their highly paraffinic nature, the waxes produced during conventional solvent dewaxing processes have been considered for use as lubestocks. Being highly paraffinic they have excellent V.I. but their high melting point generally precludes their use as automotive lubricants. Attempts have, however, been made to use them after suitable processing. The article by Bull in Developments in lubrication PD 19(2), 221–228 describes a process which subjects slack wax from a solvent (MEK-toluene) dewaxing unit to severe hydrotreating in a blocked operation together with other base stocks to produce high viscosity index (HVI) base oils. The promise of the process does not, however, appear to have been fully realized in practice since high V.I. oils of low pour point have not become commercially available. U.S. Pat. No. 4,547,283 describes a process for hydroisomerizing petroleum waxes such as slack wax using a specific type of catalyst treated with certain reactive metal compounds such as tetramethyl ammonium aluminate. Although high V.I. values are reported for the hydroisomerized wax products it is by no means clear that low pour points have been secured and accordingly it seem that the objective of matching low pour point with high V.I. in a lubricant of mineral oil origin has still to be met. A related proposal to use Foots Oil (the mixed oil/wax product of de-oiling slack wax) as a lube feedstock by dewaxing it over an intermediate pore size zeolite such as ZSM-5 is made in U.S. Pat. No. 3,960,705 but the products had relatively high pour points and the reported V.I. values do not exceed 107.

In Application Ser. No. 793,937 a process for producing high V.I., low pour point lubes from various paraffinic feeds such as slack wax or waxy gas oils such as the South East Asian gas oils is described. The process employs a first step in which a partial catalytic dewaxing is carried out with a zeolitic dewaxing catalyst which converts the waxy paraffin components is less waxy, high V.I. iso-paraffins. A subsequent, highly selective catalytic dewaxing is carried out using a highly shape selective dewaxing catalyst such as ZSM-23.

Ser. No. 044,187 describes lubricant products of extremely high quality which may be produced by a process of the type described in Application Ser. No. 793,937, using petroleum waxes as the feed. The lubricant products described here are characterized by high viscosity index (V.I.), low pour point (ASTM D-97) and retain their fluidity at low temperatures. These lubricants have a minimum V.I. of 130 and in most cases even higher values may be attained. Typical V.I. values are at least 140 and may even exceed 150 e.g., 155. The low temperature properties of the oils are outstanding:pour point (ASTM D-97) is no higher than 5° F. (−5° C.) and is typically below 0° F. (about −18° C.) and the Brookfield viscosity is less than 2500 P. at −20° F. (about −29° C.) for the basestock, i.e., additive-free stock. As manifested by the excellent high V.I., the relationship between temperature and viscosity is characterized by a relatively low decrease in viscosity with increasing temperature: at 40° C., viscosity is typically no higher than 25 cSt. while at 100° C. it is no less than 5.0 cSt and usually is higher e.g., 5.3 cSt.

These lubricants may be produced from petroleum waxes by a process of sequential hydroisomerization and hydrodewaxing as described in Ser. No. 793,937, followed by hydrotreating to remove residual aromatics and to stabilize the dewaxed product. Alternatively, the wax may first be deoiled to remove aromatics and the deoiled wax subjected to the hydroisomerization - hydrodewaxing sequence of Ser. No. 793,937 to produce the final lube base stock.

The lubricants described in Ser. No. 044,187 are highly paraffinic in nature by reason of their wax origin and because of this have a relatively low viscosity: most of the wax-derived products are of light neutral or medium neutral grade. It would be desirable to produce these high V.I., low pour point lubricants in higher viscosity grades e.g. corresponding to heavy neutral or bright stock without at the same time adversely affecting the viscosity index or pour point.

The use of peroxide treatment for modifying the viscosity of various lubestocks including distillates and hydrocracked resids has been described in U.S. Pat. Nos. 3,128,246 and 3,594,320. Other peroxide treatment processes are described in U.S. Pat. Nos. 4,594,172 and 4,618,737. Peroxide treatment has not, however, previously been proposed for use with wax-derived lubricants.

Peroxide treatment has been suggested for coupling or dimerization of Fischer-Tropsch paraffins. U.S. Pat. No. 4,594,172 (Sie) which is incorporated herein by reference, discloses converting synthesis gas to various paraffinic fractions by F-T. The $C_{10}$–$C_{19}$ fraction, which was reported by the patentee to "consist(s) virtually completely of linear paraffins" was then given two peroxide treatments to couple the F-T wax, and produce a $C_{20}+$ wax fraction.

The $C_{20}+$ wax is then hydroisomerized over a Pt on Si-Al catalyst to produce a high V.I. lube oil.

The process provided a way to make high V.I. lube oils starting from synthesis gas, but there were some drawbacks. The process relied on F-T waxes, which have virtually no sulfur- and nitrogen compounds and cyclic compounds. This represents a specialized, and relatively expensive starting material, as compared to conventional hydrocarbon fractions derived from crude oil.

Extremely high consumptions of peroxide are required. Peroxidation experiment 6 in the patent required two treatments with 50 wt.% di-tert butyl peroxide to produce a higher molecular weight product.

Yields were also somewhat lower than desired. This is because the material started with wax, used DTBP treatment to couple the wax molecules and produce extremely long wax molecules which were still not suitable for use as a lubricating oil component. The long chain ($C_{20}+$) waxy paraffins were given a hydroisomerization treatment to produce a product containing some hydroisomerized paraffins, which are high V.I. lube components. Oil yields of 21% by weight were achieved, based on the $C_{20}+$ fraction used as a starting material.

Assuming that the peroxidation experiment proceeded with 100% efficiency, 100 g of $C_{10}$-$C_{19}$ F-T wax would be converted to 100 g of $C_{20}+$ wax, by the addition of 100 g of DTBP. The $C_{20}+$ F-T waxes (obtained by peroxidation treatment) hydroisomerize to produce 21 g of oil product.

Although such a process can be used to produce an XHVI lube oil product from F-T waxes, it requires very large consumption of peroxide (100 g of peroxide were consumed to produce 21 g of product). It also required passing roughly five volumes of oil feed over a wax hydroisomerization unit to produce 1 volume of oil product (100 g of $C_{20}+$ F-T wax was converted to 21 wt.% oil yield).

We believed there must be a more efficient way to produce an XHVI lube oil, without consuming such large amounts of peroxide relative to the volume of lube oil produced. We also wanted to minimize, if possible, the amount of material that had to be sent through a [wax hydroisomerization] peroxidation? unit, which can be a relatively expensive unit operation which can result in relatively low yields of oil product. We also wanted to develop a process which could be used not only on F-T waxes, but could also tolerate as a feedstock a waxy material derived from a paraffinic crude oil. Paraffinic crude oils contain small amounts of sulfur and nitrogen, so we wanted a process which could tolerate small amounts of impurities.

SUMMARY OF THE INVENTION

We have now found that the viscosities of lubricants produced by wax hydroisomerisation-dewaxing may be modified by treatment with an organic peroxide compound. The treatment increases product viscosity without any significant adverse affect on viscosity index or pour point. In fact, with higher peroxide dosage treatment there is an improvement in lube properties; the viscosity index is increased and the lube pour point and cloud point are lowered. The process is therefore capable of making more viscous quality lubes of improved properties from wax sources.

According to the present invention there is therefore provided a process for producing a lubricant of improved viscosity index and pour point and cloud point, which comprises hydroisomerising a petroleum wax, dewaxing the hydroisomerised product by a selective dewaxing process and subjecting the dewaxed product to treatment with an organic peroxide to increase its viscosity.

The dewaxed intermediate may be hydrotreated to remove residual aromatics and to stabilize the dewaxed product or, alternatively, the wax may first be deoiled to remove aromatics and the deoiled wax subjected to the hydroisomerization - hydrodewaxing sequence of Ser. No. 793,937 to produce the final lube base stock. The former process (HI-HDW-HDT) sequence is preferred since it gives higher yields and does not require the expensive deoiling step; the second process may, however, be employed if there is sufficient solvent dewaxing capacity available for the de-oiling step or if no adequate hydrotreating capacity is available.

THE DRAWING

FIG. 1 is a graph showing the relationship between product properties and reaction temperature in a closed peroxide/oil reaction system.

DETAILED DESCRIPTION

Feedstock

Figure 1:
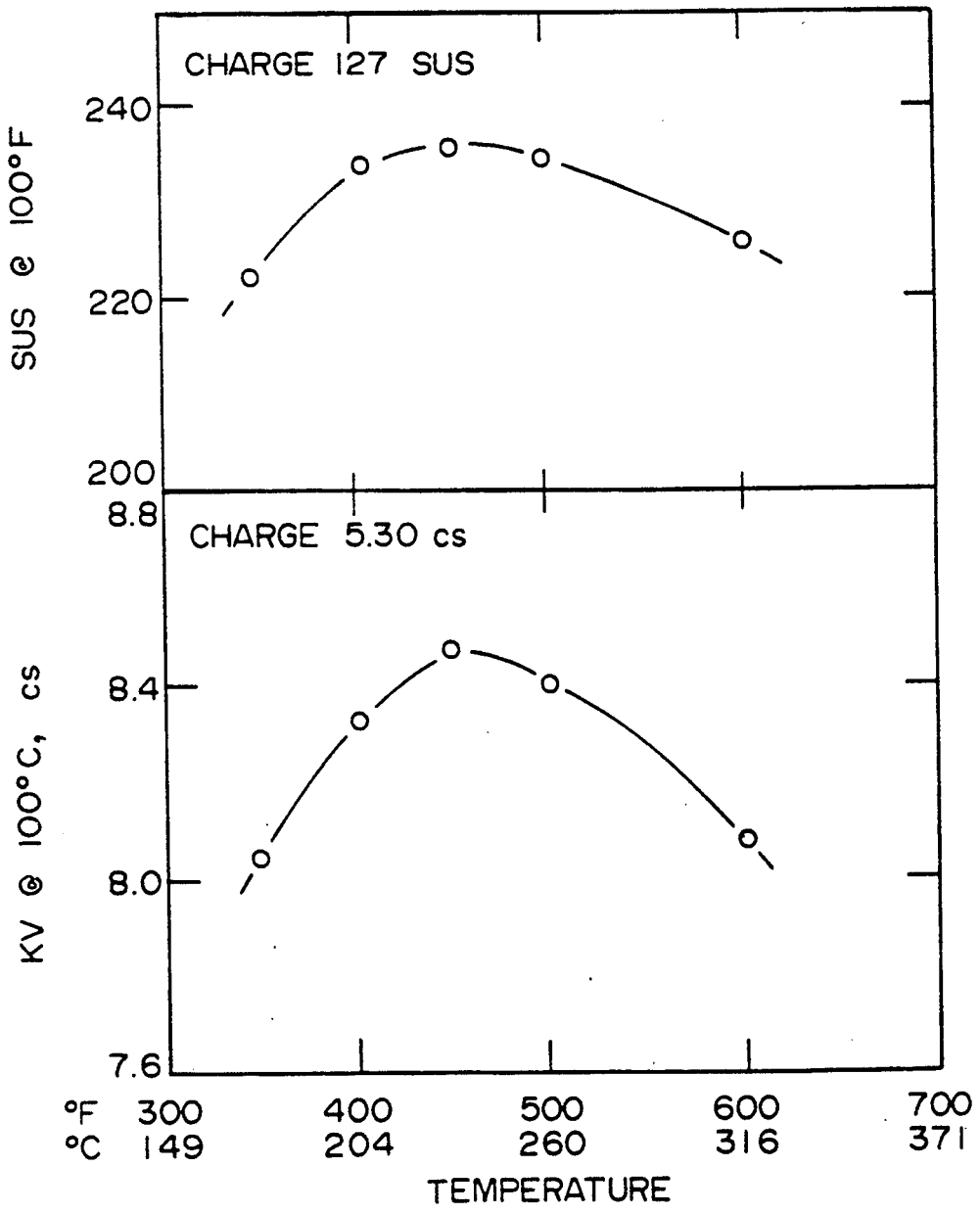

The starting materials used to make the present lube products are petroleum waxes, that is, waxes of paraffinic character derived from the refining of petroleum and other liquids by physical separation from a wax-containing refinery stream, usually by chilling the stream to a temperature at which the wax separates, usually by solvent dewaxing, e.g., MEK/toluene dewaxing or an autorefrigerant process such as propane dewaxing. Although the waxes will generally be derived from mineral oils other sources may be used, especially shale oil and synthetic production methods, especially Fischer-Tropsch synthesis which produces highly paraffinic waxes in the high boiling fractions. These waxes have high initial boiling points above about 650° F. (about 345° C.) which render them extremely useful for processing into lubricants which also require an initial boiling point of at least 650° F. (about 345° C.). The presence of lower boiling components is not to be excluded since they will be moved together with higher products produced during the processing during the separation steps which follow the characteristic processing steps. Since these components will reduce the final lube yield and, in addition, will load up the process units they are preferably excluded by suitable choice of feed cut point. The end point of the wax feed will usually be not more than about 1050° F. (about 565° C.) so that they may be classified as distillate rather than residual streams.

The paraffin content of the wax feed is high, generally at least 50, more usually at least 70, weight percent with the balance from occluded oil being divided between aromatics and naphthenics. These waxy, highly paraffinic stocks usually have much lower viscosities than neutral or residual lube stocks because of their relatively low content of aromatics and naphthenes which are high viscosity components. The high content of waxy paraffins, however, gives them melting points and pour points which render them unacceptable as lubricants without further processing.

The wax may suitably be a slack wax, that is, the waxy product obtained directly from a solvent dewaxing process, e.g. an MEK or propane dewaxing process. The slack wax, which is a solid to semi-solid product, comprising mostly highly waxy paraffins (mostly n- and mono-methyl paraffins) together with occluded oil, may be used as such or it may be subjected to an initial deoiling step of a conventional character, in order to remove the occluded oil so as to form a harder, more highly paraffinic wax which may then be passed to the hydrocracker. The oil which is removed during the de-oiling step is conventionally and rather curiously known as Foots Oil. The Foots Oil contains most of the aromatics present in the original slack wax and with these aromatics, most of the heteroatoms. Typically, Foots Oil contains 30–40 percent aromatics. The deoiling step is desirable, therefore, because it removes the undesirable aromatics and heteroatoms which would otherwise increase hydrogen consumption and catalyst aging during the hydrocracking or, alternatively, would degrade the final lubricant quality if they passed through the hydrocracker.

The compositions of some typical waxes are given in Table 1 below.

TABLE 1

| Wax Composition - Arab Light Crude | | | | |
|---|---|---|---|---|
| | A | B | C | D |
| Paraffins, wt. pct. | 94.2 | 81.8 | 70.5 | 51.4 |
| Mono-naphthenes, wt. pct. | 2.6 | 11.0 | 6.3 | 16.5 |
| Poly-naphthenes, wt. pct. | 2.2 | 3.2 | 7.9 | 9.9 |
| Aromatics, wt. pct. | 1.0 | 4.0 | 15.3 | 22.2 |

It is preferred that the content of non-paraffins should be kept as low as possible both in order to improve the final lube yield and to obtain the best combination of lube properties. (For this reason, a de-oiling step may be desired when dealing with slack waxes with relatively high levels of occluded oil.

Wax Treatment

The high melting point wax may be converted into a lubricant by a number of different processes. In a preferred process, it is subjected to hydroisomerisation and selective dewaxing as described in Ser. No. 044,187. The preferred hydroisomerisation catalyst is zeolite beta and in the dewaxing step, zeolite ZSM-23 is preferably used for its highly selective dewaxing characteristics. Because the slack wax feeds are highly paraffinic the heteroatom content is low and the wax usually may be passed directly into the hydroisomerisation step over the zeolite beta catalyst, particularly if the wax has initially been de-oiled. If de-oiling is not employed, the conditions in the first, hydroisomerisation step may be adjusted to increase the degree of hydrocracking so as to remove aromatic components in the occluded oil. In this case, the process conditions may be as described in Ser. No. 793,937, with appropriate adjustment made for the composition and content of the feed.

As an alternative to the hydroisomerisation type process of Ser. Nos. 793,937 and 044,187, a wax hydrocracking-dewaxing process may be employed, as described in Ser. No. 012,909, filed 9 Feb. 1987. Reference is made to Ser. No. 012,909 for a description of the wax hydrocracking/isomerisation-dewaxing process which may be used to prepare the wax feeds for treatment by the present peroxide treatment process. In the wax hydrocracking/isomerisation process of Ser. No. 012,909, the wax is subjected to hydrocracking/isomerisation over an amorphous catalyst which effects an isomerisation of paraffinic components in the initial feed to produce iso-paraffins of low pour point and high V.I. while, at the same time, removing residual aromatic components by saturation and ring opening to improve lube quality even further. The subsequent selective dewaxing step, preferably employing a highly shape selective dewaxing catalyst such as ZSM-23 removes the most waxy components of the hydrocracked product selectively while preserving the high V.I. iso-paraffins.

Following the initial wax hydroisomerisation or hydrocracking/isomerisation, the product still contains quantities of the more waxy straight chain, n-paraffins, together with the higher melting non-normal paraffins. Because these contribute to unfavorable pour points, and because the effluent will have a pour point which is above the target pour point for the product, it is necessary to remove these waxy components. To do this without removing the desirable isoparaffinic components which contribute to high V.I. in the product, a selective dewaxing step is carried out. This step removes the n-paraffins together with the more highly waxy, slightly branched chain paraffins, while leaving the more branched chain iso-paraffins in the process stream. Conventional solvent dewaxing processes may be used for this purpose because they are highly selective for the removal of the more waxy components including the n-paraffins and slightly branched chain paraffins, as may catalytic dewaxing processes which are more highly selective for removal of n-paraffins and slightly branched chain paraffins. This step of the process is therefore carried out as described in Ser. No. 793,937, to which reference is made for a description of this step. As disclosed there, solvent dewaxing may be used or catalytic dewaxing and if catalytic dewaxing is employed, it is preferably with a selectivity greater than that of ZSM-5. Thus, catalytic dewaxing with a highly shape selective dewaxing catalyst based on a zeolite with a constraint index of at least 8 is preferred with ZSM-23 being the preferred zeolite, although other highly shape-selective zeolites such as the synthetic ferrierite ZSM-35 may also be used, especially with lighter stocks. Typical dewaxing processes of this type are described in the following U.S. Pat. Nos.: 3,700,585 (Re 28,398), 3,894,938, 3,933,974, 4,176,050, 4,181,598, 4,222,855, 4,259,170, 4,229,282, 4,251,499, 4,343,692 and 4,247,388.

The dewaxing catalyst used in the catalytic dewaxing will normally include a metal hydrogenation-dehydrogenation component of the type described above; even though it may not be strictly necessary to promote the selective cracking reactions, its presence may be desirable to promote certain isomerization mechanisms which are involved in the cracking sequence, and for similar reasons, the dewaxing is normally carried out in the presence of hydrogen, under pressure. The use of the metal function also helps retard catalyst aging in the presence of hydrogen and, may also increase the stability of the product. The metal will usually be of the type described above, i.e. a metal of Groups IB, IVA, VA, VIA, VIIA or VIIIA, preferably of Groups VIA or VIIIA, including base metals such as nickel, cobalt, molybdenum, tungsten and noble metals, especially platinum or palladium. The amount of the metal component will typically be 0.1 to 10 percent by weight, as described above and matrix materials and binders may be employed as necessary.

Shape selective dewaxing using the highly constrained, highly shaped-selective catalysts zeolite may be carried out in the same general manner as other catalytic dewaxing processes, for example, in the same general manner and with similar conditions as those described above for the initial catalytic dewaxing step. Thus, conditions will generally be of elevated temperature and pressure with hydrogen, typically at temperatures from 250° to 500° C. (about 480° F. to 930° F.), more usually 300° to 450° C. (about 570° F. to 840° F.) and in most cases not higher than about 370° C. (about 700° F.), pressures up to 25,000 kPa, more usually up to 10,000 kPa, space velocities of 0.1 to 10 $hr^{-1}$ (LHSV), more usually 0.2 to 5 $hr^{-1}$, with hydrogen circulation rates of 500 to 1000 $n.l.l.^{-1}$, more usually 200 to 400 $n.l.l.^{-1}$. Reference is made to Serial No. 793,937 for a more extended discussion of the catalytic dewaxing step.

If solvent dewaxing is used, the wax by-product from the solvent dewaxing may be recycled to the process to increase the total lube yield. If necessary, the recycled slack wax by-product may be de-oiled to remove aromatics concentrated in the oil fraction and residual heteroatom-containing impurities. Use of the solvent dewaxing with recycle of the wax to the hydroisomerization step provides a highly efficient process which is capable of providing yield lube yields. Based on the original wax feed, the yield following the hydroisomerization-solvent dewaxing sequence is typically at least 50 volume percent and usually at least 60 volume percent or even higher, for instance, 65 volume percent, of high V.I., low pour point lube. Solvent dewaxing may be used in combination with catalytic dewaxing, with an initial solvent dewaxing followed by catalytic dewaxing to the desired final pour point and recycle of the separated wax from the solvent process.

Hydrotreating

Depending upon the quantity of residual aromatics in the dewaxed lube product it may be desirable to carry out a final hydrotreatment in order to remove at least some of these aromatics and to stabilize the product. The quantity of aromatics at this stage will depend on the nature of the feed and, of course, on the processing conditions employed. If a de-oiled wax feed is used so that the aromatics are removed at the outset in the de-oiling step, the final hydrotreatment will generally be unnecessary. Similarly, if the aromatics are sufficiently removed during the first partial dewaxing step, the hydrotreatment may also be unnecessary but because removal of aromatics at that stage will generally imply higher severity operation with increased paraffin cracking and a significant yield loss, it will generally be preferred to separate the aromatics in the subsequent hydrotreating step when the catalyst will be relatively non-acidic so that cracking will be reduced.

Conventional hydrotreating catalysts and conditions are suitably used. Catalysts typically comprise a base metal hydrogenation component such as nickel, tungsten, cobalt, nickel-tungsten, nickel-molybdenum or cobalt-molybdenum, on an inorganic oxide support of low acidity such as silica, alumina or silica-alumina, generally of a large pore, amorphous character. Typical hydrotreating conditions use moderate temperatures and pressures, e.g. 290°-425° C. (about 550°-800° F.), typically 345°-400° C. (about 650°-750° F.), up to 20,000 kPa (about 3000 psig), typically about 4250-14000 kPa (about 600-2000 psig) hydrogen pressure. Because aromatics separation is desired relatively high pressures above 7000 kPa (about 1000 psig) are favored, typically 10,000-14,000 kPa (about 1435-2000 psig). Space velocities of about 0.3-2.0, typically 1 LHSV, with hydrogen circulation rates typically about 600-1000 $n.l.l.^{-1}$ (about 107 to 5617 SCF/Bbl) usually about 700 $n.l.l.^{-1}$ (about 3930 SCF/Bbl). The severity of the hydrotreating step should be selected according to the characteristics of the feed and of the product. The objectives is to reduce residual aromatic content by saturation to form naphthenes so as to make initial improvements in lube quality by removal of aromatics and formation of naphthenes, as well as to improve the color and oxidative stability of the final lube product. It may, however, be desirable to leave some aromatics in the final lube base stock to improve solvency for certain lube additives. Conversion to products outside the lube boiling range, i.e. to 650° F. (about 345° C.−) products, will typically be no more than 10 volume percent and in most cases not more than 5 volume percent.

SULFUR AND NITROGEN CONTENT

Hydrotreating is, of course, unnecessary when F-T waxes produced by the method of U.S. Pat. No. 4,594,172 are used as a feedstock. The process of the present invention does not require such a pure feedstock, and can tolerate very well the modest amounts of sulfur and nitrogen which are present in the slack wax fractions after a wax hydroisomerization process using either zeolite beta or an amorphous catalyst.

Typical slack wax feeds to the process of the present invention will contain an excess of 10 ppm nitrogen, and more than 0.01 wt.% sulfur. Many feedstocks contemplated for use herein will contain more than 20, more than 30, or even more than 50 wt. ppm nitrogen, and more than 0.05, or even more than 0.1 wt.% sulfur.

The wax hydroisomerization treatment (whether using zeolite beta or an amorphous catalyst) will reduce significantly the sulfur and nitrogen content of the oil, but not eliminate it. Typically, low pressure zeolite beta wax hydroisomerization will reduce sulfur and nitrogen contents by 10-90%, preferably by 30-80%.

High pressure wax hydroisomerization over amorphous catalyst will usually reduce sulfur and nitrogen contents by 50-100%, and preferably by 60-95%.

One of the incidental advantages of the process of the present invention is that by conducting the wax isomerization step first, followed by peroxide treatment, the sulfur and nitrogen levels of the paraffinic feeds are reduced to levels which can be tolerated in the peroxide coupling step discussed at greater length hereafter.

The process of the present invention tolerates not only some sulfur and nitrogen in the feed, but also a modest amount of aromatics in the stock. Typically the wax feeds to the hydroisomerization process of the present invention will contain 1–20 wt.% aromatics. After hydroisomerization, and even after the optional hydrotreating step discussed above, the feedstocks of the present invention may contain 1–40 wt.% cyclics, and preferably contain 10–25 wt.% cyclics. The cyclics will be primarily naphthenic if a high pressure hydrotreating step has been employed, and primarily aromatic if no high pressure hydrotreating, or high pressure wax isomerization, processing of the feedstock has been undertaken.

Peroxide Treatment

The dewaxed product is subjected to treatment with an organic peroxide compound at elevated temperature in order to affect a coupling between the paraffinic components (paraffin molecules and alkyl side chains on ring compounds) to increase the viscosity of the lubricant.

The preferred class of peroxides which are used of the ditertiary alkyl peroxides represented by the formula $ROOR^1$ where R & $R^1$ are the same or different tertiary alkyl radicals, preferably lower ($C_4$ to $C_6$) tertiary alkyl radicals. Suitable peroxides of this kind include ditertiary butyl peroxide, ditertiary amyl peroxide and tertiary butyl, tertiary amyl peroxide. Other organic peroxides may also be used including dialkyl peroxides with one to ten carbon atoms such as dimethyl peroxide, diethyl peroxide, dipropyl peroxide, di-n-butyl peroxide, dihexyl peroxide and acetylperoxides such as dibenzoylperoxide.

The amount of peroxy compound used in the process is determined by the increase in viscosity which is desired in the treatment. In general, the increase in viscosity is related to the amount of peroxide used with greater increases resulting from greater amounts of peroxide. As a general guide, the amount of peroxide catalyst employed will be from 1 to 50, preferably from 4 to 30 weight percent of the oil. There is essentially an exponential relationship between the proportion of peroxide used and the viscosity increase, both with batch and continuous reaction. The presence of hydrogen may decrease peroxide utilisation slightly but significant increases in viscosity may still be obtained without other lube properties (pour point, V.I.) being significantly affected. It would therefore be practicable to cascade the effluent from a catalytic hydrodewaxing-/hydrotreating unit directly to a peroxide treatment reactor, permitting the hydrogen to remain in the stream. The coupling of paraffinic components out of the lube boiling range would, in this case, increase lube yield and for this reason may represent a preferred process configuration.

The reaction between the lubricant component and the peroxide is carried out at elevated temperature, suitably at temperatures from about 50° C. to about 300° C. and in most cases from 100° C. to about 200° C. The treatment duration will normally be from about 1 hour to 6 hours but there is no fixed duration since various starting materials will vary in their reactivity and amenability to coupling by this method. The pressure employed will depend upon the temperature used and upon the reactants and, in most cases, needs to be sufficient only to maintain the reactants in the liquid phase during the course of the reaction. Space velocity in continuous operation will normally be from 0.25 to 5.0 LHSV ($hr^{-1}$).

The peroxide is converted during the reaction primarily to an alcohol whose boiling point will depend upon the identity of the selected peroxide. This alcohol by-product may be removed during the course of the reaction by simple choice of temperature and pressure and accordingly temperature and pressure may be selected together to ensure removal of this by product. The alcohol may be converted back to the peroxide in an external regeneration step and recycled for further use. If ditertiary butyl peroxide is used, the tertiary butyl alcohol formed may be used directly as a gasoline octane improver or, alternatively, it may be readily converted back to the original di-tertiary butyl peroxide by reaction with butyl hydro-peroxide in the presence of a mineral acid, as described in U.S. Pat. No. 2,862,973, with the butyl hydroperoxide being obtained by the direct oxidation of isobutane, as described in U.S. Pat. No. 2,862,973.

The reaction may be carried out batchwise or continuously and in either case it is preferable to inject the peroxide compound incrementally so as to avoid exotherms and the production of lower quality products associated with high reaction temperatures. If the reaction is carried out in a continuous tubular reactor it is preferred to inject the peroxide compound at a number of points along the reactor to achieve the desired incremental addition.

The effect of the peroxide treatment is principally to increase the viscosity of the lubricant without affecting a significant reduction in viscosity index or significant increases in pour point or cloud point. The increase in viscosity implies an increase in molecular weight while the relatively constant pour point suggests that the reaction products are isoparaffinic in nature. It is thought that the action of the peroxide is by the removal of hydrogen atoms to form free radicals in non-terminal positions which then combine with each other to form branched chain dimers which are capable of reacting even more rapidly than the monomer. Thus, the viscosity of the treated material increases rapidly in the presence of additional amounts of peroxide which generate new free radicals. The greater reactivity perceived with the initial dimer may be attributed to reactive tertiary hydrogens which are present in the dimers and higher reaction products but not on the paraffins present in the starting material. The greater reactivity of the dimers indicates that the incremental addition of successively smaller amounts of peroxide, particularly in continuous tubular reactor synthesis, will produce relatively greater progressive increases in viscosity and will also ensure that the range of molecular weights in the product will be narrower and that product quality will be more consistent.

The coupled products may include very small amounts of olefins and in order to improve the stability of the final lube products, the peroxide-treated products may be subjected to mild hydrotreating to saturate any lube range olefins. Treatment over a conventional hydrotreating catalyst such as Co/Mo on alumina at mild temperatures typically to 500° F. (260° C.) at relatively low hydrogen pressures, typically up to 1000 psig (7000 kPa) will normally be satisfactory. At low hydrotreat temperatures up to about 550° F. (290° C.) viscosity loss on hydrotreating is minimal although greater losses may be observed at higher temperatures. Pour point and V.I. remain relatively constant with temperature.

Because the peroxide treatment increases the molecular weight of the hydrocarbons by a coupling reaction resulting mostly in the production of dimers with some trimer and higher reaction products, the boiling point of the product increases commensurately with the extent of the coupling reaction. It is therefore possible to employ a non-lube fraction as the feed for the peroxide treatment step i.e. a feed boiling below the lube boiling range, for example, a 600° F.− (about 315° C.−) fraction, especially the middle distillates boiling in the range of about 330°-650° F. (about 165°-345° C.). Fractions boiling below about 330° F. (about 165° C.) will normally not be preferred because excessive peroxide consumption is necessary to bring these naphtha range materials into the lube boiling range.

PEROXIDE EFFICIENCY

The process of the present invention is exceedingly efficient in its use of peroxide compound. Rather than using large amounts of peroxide (100 wt.% was used in Example 6 of the Sie reference) to couple wax molecules to wax molecules, to produce long wax molecules which must be subjected to further treatments to produce relatively low yields of oil, the process of the present invention has a different approach. The relatively expensive, and potentially low yield, wax isomerization step is conducted first. The hydroisomerized paraffins are then given a peroxide treatment. For reasons which are not completely understood, our process permits efficient coupling of $C_{10}$-$C_{19}$ hydroisomerized waxes to produce $C_{20}$+ XHVI oil. We don't need 100 wt.% peroxy compound. We can achieve efficient coupling with as little as 10 or 20 wt.% peroxide compound.

Because the starting material for peroxide treatment is a relatively highly branched paraffinic product, the product of the peroxide treatment is also a highly branched paraffinic product which is an excellent XHVI lube stock. No further treatment is necessary, although an additional shape selective or solvent dewaxing step may be performed to produce an XHVI lube product with an extremely low pour point.

The efficiency of our process for producing XHVI lube oil can best be appreciated by comparing it to the closest known prior art process, Sie U.S. Pat. No. 4,594,172.

In the Sie process, 100 g of short chain wax is coupled by reaction with 100 g of DTBP. This material is then hydroisomerized to produce 21 g of XHVI lube oil. There is a peroxide consumption of roughly 5 grams per gram of product.

In the process of our invention, as will be shown by the examples presented hereafter, we can efficiently couple our short chain paraffinic materials using only 10-20 wt.% peroxide. Thus 100 g of starting material (isoparaffins) is coupled using 10-20 g of peroxide. The product is essentially 100 wt.% XHVI lube oil. 100 g of product are obtained per 10-20 g of DTBP consumed.

Phrased another way, our process makes 100 g of XHVI lube product by peroxidation treatment of 100 g of feed with 20 g of peroxide.

The Sie process, in order to produce 100 g of XHVI product, would require 475 g of oil feed to the peroxide treatment zone, and approximately 475 g DTBP.

Products

The dewaxed lubricant products of the present process are characterized by a high viscosity index coupled with a low pour point. Viscosity indices of at least 130, e.g. 140 or 150 are characteristic of the highly paraffinic nature of the products but with low pour points indicating a significant quantity of iso-paraffinic components. Pour points below 10° F. for the basestock (i.e., without pour point improvers or other additives) and in most cases below 5° F. are readily attained, e.g. 0° F. with correspondingly low Brookfield viscosities, e.g., less than 2500 p. at −20° F. Use of the present viscosity modification process enables product viscosity to be increased from that of a light neutral to that of heavy neutral or a bright stock with little or no adverse effect on product viscosity index or pour point. Thus, the present lubricant basestocks have an extremely good combination of properties making them highly suitable for formulation into finished multiviscosity and high viscosity lubricants with additives such as pour point improvers (to effect further pour point reductions), antioxidants, anti-wear agents and extreme pressure agents.

EXAMPLE 1

This example illustrates the use of peroxide treatment with a wax derived lube produced by high pressure wax hydrocracking. The charge in this example was an extra high viscosity index (XHVI) lube basestock, 147 viscosity index and +10° F. pour point. The properties of the stock are as shown in Table 2.

TABLE 2

| XHVI Lube | |
|---|---|
| Gravity, | |
| °API | 39.5 |
| Specific | 0.8275 |
| Pour Point, °F. (°C.) | +10 (−12) |
| K.V. @ 40° C., cs. | 26.37 |
| K.V. @ 100° C., cs. | 5.45 |
| SUS @ 100° F. (38° C.) | 136 |
| SUS @ 210° F. (99° C.) | 44.5 |
| Viscosity Index | 147 |
| H, wt % | 14.86 |
| S, wt % | 0.002 |
| N, ppm | 1 |
| Distillation, °F. (D-2887) | |
| 1% | 650 |
| 10% | 713 |
| 30% | 782 |
| 50% | 835 |
| 70% | 891 |
| 90% | 983 |
| 95% | 1025 |

In each run of this Example, 100 g of the stock was placed in a 500 round bottom flask equipped with a stirrer, thermometer, water condenser, condenser liquid take-off and dropping burette. The flask was heated to 150° C., and ditertiary butylperoxide (DTBP) added dropwise from the burette over a 1 hour period. The temperature was held at 150° C. for an additional 3 hours, then raised to about 185° C. in the next 2 hours. The contents were then cooled to room temperature, and topped, first at atmospheric pressure to a pot temperature of 300° C., then under a vacuum of 0.1 mm pressure to a pot temperature of 190° C. to remove any DTBP decomposition products not condensed in the take-off during the reaction period.

Two quantities of DTBP were used, with results as shown in Table 3.

TABLE 3

| DTBP Treatment of XHVI Lube | | | |
|---|---|---|---|
| Run No. | Charge Stock | 1-1 | 1-2 |
| Stock, g | | 100 | 100 |
| DTBP, g | | 10 | 20 |
| Lube Yield, wt % | | 100.6 | 100.6 |
| Lube Properties | | | |
| Gravity, | | | |
| °API | 39.5 | 37.6 | 36.6 |
| Specific | 0.8275 | 0.8368 | 0.8418 |
| Pour Point, °F. (°C.) | +10 (−12) | +5 (−15) | 0 (−18) |
| K.V. @ 40° C., cs. | 26.37 | 45.01 | 68.78 |
| K.V. @ 100° C., cs | 5.45 | 7.97 | 10.85 |
| SUS @ 100° F. (38° C.) | 136 | 229 | 351 |
| SUS @ 210° F. (99° C.) | 44.5 | 52.9 | 63.2 |
| Viscosity Index | 147 | 149.9 | 147.9 |

The results show that the viscosity increases directly with the amount of DTBP used, with no adverse effect on pour point or viscosity index.

EXAMPLE 2

This Example illustrates the incremental addition of DTBP.

The charge in this Example was 50 g of the product of Example 1 Run 1-2, reacted with 10 g DTBP in the manner described in Example 1, with results as given in Table 4.

TABLE 4

| DTBP 2-Stage Addition | | |
|---|---|---|
| | Charge Stock | |
| Lube Yield, wt % | | 100.1 |
| Lube Properties | | |
| Gravity, | | |
| °API | 36.6 | 34.1 |
| Specific | .8418 | 0.8550 |
| Pour Point, °F. (°C.) | 0 (−18) | +5 (−15) |
| K.V. @ 40° C., cs | 68.78 | 246.6 |
| K.V. @ 100° C., cs | 10.85 | 28.56 |
| SUS @ 100° F. (38° C.) | 351 | 1276 |
| SUS @ 210° F. (99° C.) | 63.2 | 139.7 |
| Viscosity Index | 147.9 | 152.4 |

This example demonstrates that viscosity can be increased still further to that of a bright stock by continued addition of DTBP.

EXAMPLE 3

This Example illustrates the peroxide treatment of a catalytically dewaxed lubestock.

The starting material was the XHVI lube of Example 1. This stock was hydrodewaxed over 1% Ni/ZSM-5 in a pilot plant run at 400 psig, 1 LHSV, 2500 SCF $H_2$/bbl, 550° F., (2860 kPa abs, 445 n.1.1$^{-1}$ m $H_2$, 290° C.), giving 78 wt% yield of 650° F.+ product. A 100 g portion of this was reacted with 10 g of DTBP as described in Example 1 with the results shown in Table 5.

TABLE 5

| DTBP Treatment of Dewaxed Lube | | |
|---|---|---|
| | Charge Stock | |
| Lube Yield, wt % | | 98.1 |
| Lube Properties | | |
| Gravity, | | |
| °API | 37.6 | 35.8 |
| Specific | 0.8368 | 0.8458 |
| Pour Point, °F. (°C.) | −30 (−34) | −30 (−34) |
| K.V. @ 40° C., cs | 26.18 | 59.43 |
| K.V. @ 100° C., cs | 5.31 | 9.23 |
| SUS @ 100° F. (38° C.) | 135 | 304 |
| SUS @ 210° F. (99° C.) | 44.0 | 57.3 |
| Viscosity Index | 140.6 | 135.1 |

This Example Shows that the hydrodewaxed stock responds to the DTBP treatment, the viscosity increase being greater than that obtained on the original charge at the same DTBP level (Example 1 Run 1-1).

EXAMPLE 4

This Example illustrates the dewaxing of a hydrocracked wax derived lube over a ZSM-5 dewaxing catalyst.

The XHVI lube of Example 1 was hydrodewaxed over 0.39 wt% Pd/ZSM-5, in a microunit at 400 psig, 1 LHSV, 2500 SCF $H_2$/bbl, 500° F., (2860 kPa, 445 n.1.1.$^{-1}H_2$, 260° C.) giving a 67 wt% yield of 650° F.+ product. A 41 g portion of this was reacted with 8 g of DTBP as described in Example 1, with the results shown in Table 6.

TABLE 6

| | Charge Stock | |
|---|---|---|
| Lube Yield, wt % | | 100.5 |
| Lube Properties | | |
| Gravity, | | |
| °API | 38.7 | 35.7 |
| Specific | 0.8314 | 0.8463 |
| Pour Point, °F. (°C.) | *−65 (*−54) | −65 (−54) |
| K.V. @ 40° C., cs | 27.62 | 77.53 |
| K.V. @ 100° C., cs | 5.31 | 11.04 |
| SUS @ 100° F. (38° C.) | 142 | 398 |
| SUS @ 210° F. (99° C.) | 44.0 | 64.0 |
| Viscosity Index | 127.8 | 131.2 |

*less than

This is a second example of hydrowaxing over ZSM-5, using palladium instead of nickel, before reaction with DTBP.

EXAMPLE 5

The XHVI lube of Example 1 was hydrodewaxed over 1 wt% Pt/ZSM-23 in a microunit at 400 psig, 1 LHSV, 2500 SCF $H_2$/bbl, 695° F., (2860 kPa, 1 hr$^{-1}$, 445 n.1.1.$^{-1}H_2$, 368° C.), giving an 81 wt% yield of 650° F.+ product. A 50 g portion of this was reacted with 10 g DTBP as described in Example 1, with the results shown in Table 7:

TABLE 7

| | Charge Stock | |
|---|---|---|
| Lube Yield, wt % | | 100.8 |
| Lube Properties | | |
| Gravity, | | |
| °API | 38.9 | 35.5 |
| Specific | 0.8304 | 0.8473 |
| Pour Point, °F. (°C.) | *−65 (*−54) | *−65 (*−54) |
| K.V. @ 40° C., cs | 24.67 | 78.25 |
| K.V. @ 100° C., cs | 5.05 | 11.52 |
| SUS @ 100° F. (38° C.) | 127 | 401 |
| SUS @ 210° F. (99° C.) | 43.2 | 65.7 |

TABLE 7-continued

| | Charge Stock | |
|---|---|---|
| Viscosity Index | 136.0 | 139.3 |

*less than

EXAMPLE 6

This Example illustrates the preparation of a hydroisomerised-dewaxed lube from slack wax with peroxide treatment of the dewaxed product. Heavy neutral slack wax was first processed over 0.6 wt % Pt/Zeolite beta catalyst in a pilot plant run at 400 psig, 1.3 LHSV, 2000 SCF $H_2$/bbl, 745° F., (2860 kPa, 1.3 $hr^{-1}$, 356 n.1.1.$^{-1}$ $H_2$, 395° C.), and the 650° F.+ bottoms product solvent dewaxed using MEK/toluene to +10° F. pour, overall yield 51 wt.%. A 100 g portion, 650° F.+, was reacted with 20 g DTBP as described in Example 1, with the results shown in Table 8.

TABLE 8

| | Charge Stock | |
|---|---|---|
| Lube Yield, wt % | | 100.4 |
| Lube Properties | | |
| Gravity, | | |
| °API | 37.5 | 33.3 |
| Specific | 0.8373 | 0.8586 |
| Pour Point, °F. (°C.) | +10 (−12) | +10 (−12) |
| K.V. @ 40° C., cs | 32.44 | 101.2 |
| K.V. @ 100° C., cs | 6.205 | 14.19 |
| SUS @ 100° F. (38° C.) | 166 | 520 |
| SUS @ 210° F. (99° C.) | 47 | 76.2 |
| Viscosity Index | 143.5 | 143.3 |

EXAMPLE 7

Heavy neutral slack wax was first deoiled, then processed over 0.6 wt% Pt/zeolite Beta catalyst in a pilot plant run at 400 psig, 1.3 LHSV, 2000 SCF $H_2$/bbl, 705° F., (2860 kPa, 1.3 $hr^{-1}$, 356 n.1.1.$^{-1}$ $H_2$, 375° C.), and the 650° F.+ product solvent dewaxed using MEK/toluene to +5° F. pour, overall yield 30 wt%. A 100 g portion, 650° F.+, was reacted with 20 g DTBP as described in Example 1, with the results shown in Table 9.

TABLE 9

DTBP Treatment of HI-DW Slack Wax

| | Charge Stock | |
|---|---|---|
| Lube Yield, wt % | | 101.2 |
| Lube Properties | | |
| Gravity, | | |
| °API | 37.5 | 35.6 |
| Specific | 0.8373 | 0.8468 |
| Pour Point, °F. (°C.) | +5 (−15) | +5 (−15) |
| K.V. @ 40° C., cs | 26.60 | 83.16 |
| K.V. @ 100° C., cs | 5.59 | 13.00 |
| SUS @ 100° F. (38° C.) | 136 | 424 |
| SUS @ 210° F. (99° C.) | 44.9 | 71.4 |
| Viscosity Index | 156.0 | 156.7 |

This Example demonstrates the very high viscosity index obtainable by first deoiling the wax.

EXAMPLE 8

This Example demonstrates that hydrocracked wax can be hydrodewaxed directly, eliminating the intermediate solvent dewaxing step, before reaction with DTBP. Slack wax was first processed over a commercial Ni/W/Al/F catalyst containing of 4.6 wt % Ni, 22.8 wt % W, with addition of 25 ppm F as O-fluorotoluene in the feed, in a pilot plant run at 2000 psig, 0.8 LHSV, 2500 SCF $H_2$/bbl, and 775° F., (13890 kPa, 0.8 $hr^{-1}$, 445 n.1.1.$^{-1}$, $H_2$, 413° C.) giving a 72 wt % yield of 610° F.+ product having a pour point of +120° F. This product was then hydrodewaxed over 0.5 wt % Pt/ZSM-23 in a microunit run at 400 psig, 1 LHSV, 2500 SCF $H_2$/bbl, 630° F., (2860 kPa, 1 $hr^{-1}$, 445 n.1.1.$^{-1}$$H_2$, 330° C.) giving a 60 wt % yield of 610° F.+ product having a pour point of +10° F. (overall yield, based on wax charge, 43 wt %). A 50 g portion was reacted with 10 g DTBP as described in Example 1, with the results shown in Table 10.

TABLE 10

DTBP Treatment of Wax Derived Lube

| | Charge Stock | |
|---|---|---|
| Lube Yield, wt % | | 101.5 |
| Lube Properties | | |
| Gravity, | | |
| °API | 38.8 | 35.7 |
| Specific | 0.8309 | 0.8463 |
| Pour Point, °F. (°C.) | +10 (−12) | +20 (−7) |
| K.V. @ 40° C., cs | 27.35 | 82.28 |
| K.V. @ 100° C., cs | 5.43 | 12.25 |
| SUS @ 100° F. (38° C.) | 141 | 421 |
| SUS @ 210° F. (99° C.) | 44.1 | 68.5 |
| Viscosity Index | 138.2 | 144.8 |

EXAMPLE 9

This Example illustrates the peroxide treatment of a dewaxed middle distillate.

A heavy neutral slack wax having the properties set out in Table 11 was hydroisomerised over zeolite beta and solvent dewaxed as described in Example 6.

TABLE 11

HN Slack Wax

| | |
|---|---|
| Gravity, | |
| °API | 35.8 |
| Specific | 0.8458 |
| Hydrogen, wt % | 14.11 |
| Sulfur, wt % | 0.082 |
| Nitrogen, ppm | 33 |
| KV @ 100° C., cs | 8.515 |
| Oil Content, wt % | 14.15 |

The 330-650° F. fraction from the hydroisomerisation step was obtained in a yield of 23.0 wt% and its properties were as set out in Table 12.

TABLE 12

Hydroisomerised 330°-650° F. Fraction

| | |
|---|---|
| Gravity, | |
| °API | 50.3 |
| Specific | 0.7783 |
| Pour Point, °F. (°C.) | −65 (−54) |
| Hydrogen, wt % | 15.26 |
| Bromine No. (D-1159) | 0.0 |
| Boiling Range, °F. (D-2887) | |
| 1% | 314 |
| 5 | 333 |
| 10 | 355 |
| 30 | 416 |
| 50 | 475 |
| 70 | 541 |
| 90 | 617 |
| 95 | 640 |
| 99 | 660 |

TABLE 12-continued

| Hydroisomerised 330°-650° F. Fraction | |
|---|---|
| Mol. Wt. (Calc.) | 220 |

The bromine number indicates that the fraction does not contain olefinic compounds, and the hydrogen content indicates that it is essentially all paraffinic (average carbon No 15, calculated 15.31 wt% H).

This fraction was reacted with two quantities of DTBP in the manner described in Example 1, with the results shown in Table 13.

TABLE 13

| DTBP Treatment of Middle Distillate | | |
|---|---|---|
| Run No. | Charge Stock 9-1 | 9-2 |
| Charge, g | 100 | 100 |
| DTBP, g | 20 | 30 |
| 650° F. yield, wt %(1) | 29 | 34 |
| Lube Yield, wt %(2) | 27 | 30 |
| Lube Properties | | |
| Gravity, | | |
| °API | 33.1 | 32.1 |
| Specific | 0.8597 | 0.8649 |
| Pour Point, °F. (°C.) | −30 (−34) | −30 (−34) |
| K.V. @ 40° C., cs | 71.13 | 154.6 |
| K.V. @ 100° C., cs | 9.40 | 15.10 |
| SUS @ 100° F. (38° C.) | 368 | 812 |
| SUS @ 210° F. (99° C.) | 58.0 | 80.1 |
| Viscosity Index | 109.3 | 97.7 |

Notes:
(1)Based on D-2887
(2)Actual distillation

It is significant that increasing DTBP resulted in little increase in lube yield, but a big increase in viscosity. An explanation for this is that only the more highly branched paraffins with the more labile (extractable) hydrogen atoms are reacting with the butoxy radicals, and the resulting isoparaffin dimerization product is still more reactive than the unreacted paraffins.

EXAMPLE 10

A deoiled wax was used as a charge to a hydroisomerisation step. The wax had the properties set out in Table 14.

TABLE 14

| Deoiled Wax | |
|---|---|
| Gravity, | |
| °API | 38.6 |
| Specific | 0.8319 |
| Hydrogen, wt % | 14.37 |
| Sulfur, wt % | 0.001 |
| Nitrogen, ppm | 3 |
| KV @ 100° C., cs | 7.477 |
| Oil Content, wt % | 2.0 |

The deoiled was hydroisomerised over zeolite beta as described in Example 7.

The 330-650° F. fraction from the hydroisomerisation step was reacted with DTBP. The yield of this fraction from the hydroisomerisation was 21.6 wt%, and properties as set out in Table 15.

TABLE 15

| Hydroisomerised 330°-650° F. Fraction | |
|---|---|
| Gravity, | |
| °API | 50.2 |
| Specific | 0.7788 |

TABLE 15-continued

| Hydroisomerised 330°-650° F. Fraction | |
|---|---|
| Pour Point, °F. (°C.) | −55 (−48) |
| Hydrogen, wt % | 15.12 |
| Bromine No. (D-1159) | 0.6 |
| Boiling Range, °F. (D-2887) | |
| 1% | 322 |
| 5 | 343 |
| 10 | 364 |
| 30 | 420 |
| 50 | 482 |
| 70 | 546 |
| 90 | 613 |
| 95 | 632 |
| 99 | 654 |
| Mol. Wt. (Calc.) | 220 |

The properties were very similar to those of the previous example. The fraction was reacted with DTBP, with the results set out in Table 16.

TABLE 16

| Peroxide Treated Product | |
|---|---|
| Charge, g | 100 |
| DTBP, g | 30 |
| 650° F. yield, wt % | 37 |
| Lube Yield, wt % | 33 |
| Lube Properties | |
| Gravity, | |
| °API | 30.8 |
| Specific | 0.8718 |
| Pour Point, °F. (°C.) | −25 (−32) |
| K.V. @ 40° C., cs | 180.5 |
| K.V. @ 100° C., cs | 16.88 |
| SUS @ 100° F. (38° C.) | 950 |
| SUS @ 210° F. (99° C.) | 87.6 |
| Viscosity Index | 98.8 |

Pour point and viscosity index are about the same as those of the lube starting with the slack wax (Example 9), but both yield and viscosity are higher.

EXAMPLE 11

This Example illustrates the use of a closed, continuous treatment system for the peroxide-oil reaction.

A blend of 10 parts by weight DTBP to 100 parts by weight of a wax derived lube produced by the hydroisomerisation of a heavy neutral wax over a Pt/zeolite beta catalyst at 400 psig, 1.3 LHSV, 2000 SCF/bbl, 700° F. (2860 kPa, 1.3 $hr^{-1}$, 356 n.l.l.$^{-1}H_2$, 370° C.) followed by topping the liquid product to 650° F. (345° C.) cut point and solvent dewaxing to 0° F. (−18° C.) cut point. The blend was pumped into a quartz-filled reactor over varying conditions to investigate the effects of temperature and pressure. The conditions used were as set out in Table 17.

TABLE 17

| Continuous Treatment Conditions | |
|---|---|
| Pressure, psig, (kPa abs.) | 100-1500 (790-10445) |
| Temperature °F. (°C.) | 300-600 (150-315) |
| LHSV, $hr^{-1}$ | 0.25-0.5 |

The reactor was a 0.375 inch (9.5 mm.) i.d. stainless steel cylinder filled with 10 cc (14.1 g) 14-25 mesh (Tyler) quartz. For comparison, a stirred flask experiment was made using the same weight proportions of DTBP and lube and the procedures described above. Run data are set out in Table 18.

The stirred flask reaction was carried out at 150° C. with 10 g DTBP added dropwise over a 1 hour period to 100 g of the lube. The temperature was held at 150° C. for an additional 3 hours then raised to 185° C. in the next hour. The liquid product was topped at 0.07 mm Hg pressure, maximum pot temperature 190° C.

In all cases lube yield was essentially 100 percent within experimental error.

TABLE 18

Lube Viscosity Increase Using Ditertiary Butyl Peroxide

| Reaction System | Wax Lube | Stirred | Quartz-Filled, Fixed Bed Reactor | | | |
|---|---|---|---|---|---|---|
| Run No. | Charge | Flask | 11-1 | 11-2 | 11-3 | 11-4 |
| Pressure, psig | | 0 | (----------100----------) | | | 400 |
| LHSV | | — | (----------0.5----------) | | (----------0.25---------- | |
| Temp., | | | | | | |
| °F. | | | 301 | 352 | 351 | 351 |
| °C. | | | 150 | 178 | 177 | 179 |
| Lube Properties | | | | | | |
| Gravity, | | | | | | |
| °API | 38.0 | 36.7 | 37.9 | 37.6 | 37.4 | 37.3 |
| Specific | 0.8348 | 0.8413 | 0.8353 | 0.8368 | 0.8378 | 0.8383 |
| Pour Point, °F. (°C.) | 0 (−18) | 0 (−18) | −5 (−20) | −5 (−20) | −5 (−20) | −5 (−20) |
| Cloud Point, °F. (°C.) | 22 (−5) | 4 (−15) | +8 (−13) | +8 (−13) | +8 (−13) | +8 (−13) |
| KV @ 40° C., cs | 24.67 | 45.46 | 37.27 | 41.32 | 42.88 | 44.16 |
| KV @ 100° C., cs | 5.30 | 8.25 | 7.08 | 7.66 | 7.92 | 8.08 |
| SUS @ 100° F. (38° C.) | 127 | 231 | 190 | 210 | 218 | 225 |
| SUS @ 210° F. (99° C.) | 44.0 | 43.9 | 49.9 | 51.9 | 52.7 | 53.3 |
| Viscosity Index | 155.0 | 157.8 | 154.8 | 156.6 | 158.3 | 157.9 |

| Reaction System | Quartz-Filled, Fixed Bed Reactor | | | | | |
|---|---|---|---|---|---|---|
| Run No. | 11-5 | 11-6 | 11-7 | 11-8 | 11-9 | 11-10 |
| Pressure, psig | 1000 | | | 1500 | | |
| LHSV | ----------0.25---------) | | | | | |
| Temp., | | | | | | |
| °F. | 354 | 353 | 403 | 450 | 502 | 598 |
| °C. | 179 | 178 | 206 | 232 | 261 | 314 |
| Lube Properties | | | | | | |
| Gravity, | | | | | | |
| °API | 37.3 | 37.3 | 37.2 | 37.1 | 37.3 | 37.1 |
| Specific | 0.8383 | 0.8383 | 0.8388 | 0.8393 | 0.8383 | 0.8395 |
| Pour Point, °F. (°C.) | 0 (−18) | 0 (−18) | −5 (−20) | −5 (−20) | −10 (−23) | +5 (−15) |
| Cloud Point, °F. (°C.) | +4 (−15) | +10 (−12) | +12 (−11) | +4 (−15) | +8 (−13) | NA* |
| KV @ 40° C., cs | 46.77 | 43.67 | 45.98 | 46.51 | 46.20 | 43.83 |
| KV @ 100° C., cs | 8.44 | 8.045 | 8.33 | 8.48 | 8.40 | 8.075 |
| SUS @ 100° F. (38° C.) | 238 | 222 | 234 | 236 | 235 | 223 |
| SUS @ 210° F. (99° C.) | 54.5 | 53.2 | 54.1 | 54.7 | 54.4 | 53.3 |
| Viscosity Index | 158.3 | 159.2 | 158.2 | 161.0 | 159.8 | 159.5 |

*None

Effect of Temperature

FIG. 1 is a plot of viscosity vs. temperature at 1500 psig, 0.25 LHSV, (20445 kPa, 0.25 $hr^{-1}$) showing a maximum viscosity at 450° F. (230° C.). At that temperature, viscosity exceeded that obtained in the stirred flask, as shown in Table 19.

TABLE 19

| Temp, °F. (°C.) | (Charge) | (Stirred) (Flask) | Effect of Temperature 353 (178) | 403 (206) | 450 (252) | 502 (261) | 598 (315) |
|---|---|---|---|---|---|---|---|
| Pour Pt. °F. (°C.) | 0 (−18) | 0 (−18) | 1 (−18) | −5 (−20) | −5 (−20) | −10 (−23) | +5 (−15) |
| SUS @ 100° F. (38° C.) | 127 | 231 | 222 | 234 | 236 | 235 | 223 |
| KV @ 100° C., cs | 5.30 | 8.25 | 8.045 | 9.33 | 8.48 | 8.49 | 8.075 |
| V.I. | 155.0 | 157.8 | 159.2 | 158.2 | 161.0 | 159.8 | 159.5 |

At temperatures below 450° F. (232° C.) it is likely that the DTBP has not completely dissociated to isobutoxy radicals. At the higher temperatures, undesirable side reactions are apparently taking place.

Accordingly, it can be seen that the process of the present invention provides a highly efficient way of converting a waxy material to a high viscosity index lube stock.

The process of the present invention permits XHVI lube oil products to be obtained from many starting materials, ranging from the exotic and expensive F-T waxes, to paraffinic wax feeds produced from a paraffinic crude oil.

The process is efficient both in its use of chargestock and its use of peroxide compound. The paraffinic feedstock is hydroisomerized first, and then given a peroxide treatment. By peroxide treating a hydroisomerized wax (as opposed to using peroxide treatment to couple waxes and make extremely long chain waxes) essentially stoichiometric yields of XHVI lube components are obtained from the peroxide treatment step. Such yield losses as occur during the hydroisomerization step (and using Pt on an amorphous support gives relatively low yields of hydroisomerized oil), are limited to the hydroisomerization reactor.

The process of the present invention permits efficient conversion of waxy feeds to XHVI oils, by the steps of hydroisomerization and peroxide treatment. Cur process permits use of a peroxide treatment reactor which can be smaller than the reactors required by the prior art processes, while making over an order of magnitude more efficient use of the peroxide compound. Our hydroisomerization reactor (whether using zeolite beta as a catalyst or using an amorphous catalyst) is also somewhat easier to design and operate because of the lighter chargestock. It is easier to design and operate a plant having as a feedstock a relatively low molecular weight paraffinic fraction ($C_{10}$–$C_{19}$ paraffins) as opposed to one which has as a feedstock $C_{20}+$ paraffins.

We claim:

1. A process for producing a 140 and higher V.I., low pour point lubricant from a deoiled slack wax feed containing 10 ppm nitrogen, and more than 0.01 wt% sulfur, the process comprising:

(i) partially dewaxing the feed in an initial catalytic dewaxing step by contacting the feed under dewaxing conditions of elevated temperature and pressure in the presence of hydrogen with a dewaxing catalyst comprising zeolite beta and a hydrogenation-dehydrogenation component, to effect a partial removal of the waxy components by isomerization of the waxy paraffinic components to less waxy iso-paraffinic components, to produce a partially dewaxed effluent, (ii) subjecting the partially dewaxed effluent to a selective dewaxing operation to effect a further removal of waxy components to produce a dewaxed lubricant fraction, and (iii) subjecting the dewaxed lubricant fraction to treatment with an organic peroxide with an amount of organic peroxide equal to 1 to 50 wt% of the dewaxed lubricant fraction to increase the viscosity of the fraction.

2. A process according to claim 1 in which the peroxide comprises a ditertiaryalkyl peroxide.

3. A process according to claim 1 in which the peroxide comprises ditertiary butyl peroxide.

4. A process according to claim 1 in which the fraction is treated with the peroxide at a temperature of 100° to 300° C.

5. A process according to claim 1 in which the wax feed has a paraffin content of at least 70 weight percent.

6. A process according to claim 1 in which the zeolite beta has a silica:alumia ratio of at least 10.1.

7. A process according to claim 1 in which the zeolite beta has a silica:alumina ratio of at least 30.1.

8. A process according to claim 1 in which the selective dewaxing operation is a catalytic dewaxing over a dewaxing catalyst comprising zeolite ZSM-5.

9. A process according to claim 8 in which the dewaxing catalyst comprises a metal component having hydrogenation functionality and ZSM-5.

10. A process according to claim 9 in which the metal component is nickel.

11. A process according to claim 1 in which a fraction boiling below the lube boiling range is separated from the partially dewaxed effluent and subjected to treatment with an organic peroxide to bring its molecular weight into the lubricant range.

12. A process for producing a 140 and higher viscosity index lubricant from a deoiled slack wax feed which comprises:

(i) subjecting the wax feed to hydrocracking/isomerization in the presence of a hydrocracking/isomerization catalyst comprising a hydrogenation-dehydrogenation component on a porous, acidic, amorphous carrier, to hydrocrack aromatics in the feed and isomerize waxy paraffins to form iso-paraffins, (ii) subjecting the hydrocracked product to catalytic dewaxing over a ZSM-23 zeolite catalyst to produce a dewaxed lubricant fraction, (iii) subjecting the dewaxed lubricant fraction to treatment with an organic peroxide compound to increase the viscosity of the fraction.

13. The process of claim 12 in which the peroxide comprises a ditertiaryalkyl peroxide.

14. The process of claim 12 in which the peroxide comprises a ditertiary butyl peroxide.

15. The process of claim 12 in which the peroxide treatment occurs at 100° to 300° C.

16. The process of claim 12 in which the amount of peroxide used to treat the fraction is from 1 to 50 weight percent of the fraction.

17. The process of claim 12 in which feed is a slack wax with a paraffin content of at least 70 weight percent.

18. A process for producing a lubricant having a V. I. of at least 140 and a pour point of −30° F. or lower from a deoiled slack wax wax feed comprising:

(i) partially dewaxing the feed in an initial catalytic dewaxing step by contacting the feed under dewaxing conditions of elevated temperature and pressure in the presence of hydrogen with a dewaxing catalyst comprising zeolite beta and a hydrogenation-dehydrogenation component or a dewaxing catalyst comprising a hydrogenation-dehydrogenation component on an porous, acidic, amorphous carrier, to effect a partial removal of the waxy components by isomerization of the waxy paraffinic components to less waxy iso-paraffinic components, to produce a partially dewaxed effluent, (ii) catalytically dewaxing the partially dewaxed effluent over an intermediate pore zeolite to effect a further removal of waxy components to produce a dewaxed lubricant fraction having a maximum pour point of −30° F., and (iii) subjecting the dewaxed lubricant fraction to treatment with an organic peroxide with an amount of organic peroxide equal to 1 to 50 wt% of the dewaxed lubricant fraction to increase the viscosity of the fraction and produce a lubricant having a viscosity index of at least 140 and a maximum pour point of −30° F.

19. The process of claim 18 wherein the pour point of the high viscosity index lubricant is below −65° F.

* * * * *